United States Patent [19]

Wilson et al.

[11] 4,425,201

[45] Jan. 10, 1984

[54] METHOD FOR IMPROVED ALUMINA CONTROL IN ALUMINUM ELECTROLYTIC CELLS

[75] Inventors: Claude A. Wilson, Rio de Janeiro, Brazil; Alton T. Tabereaux, Sheffield, Ala.

[73] Assignee: Reynolds Metals Company, Richmond, Va.

[21] Appl. No.: 343,210

[22] Filed: Jan. 27, 1982

[51] Int. Cl.[3] ..... C25C 3/06; C25C 3/20

[52] U.S. Cl. ..... 204/67

[58] Field of Search ..... 204/67

[56] References Cited

U.S. PATENT DOCUMENTS 3,622,475 11/1971 Shiver et al. ..... 204/67

3,712,857 1/1973 Piller ..... 204/67

3,812,024 5/1974 Goodnow et al. ..... 204/67

FOREIGN PATENT DOCUMENTS 1145820 3/1969 United Kingdom ..... 204/67

*Primary Examiner*—Howard S. Williams

*Attorney, Agent, or Firm*—Alan T. McDonald

[57] ABSTRACT

A method of controlling alumina additions to aluminum reduction cells is disclosed. Changes in cell resistance with respect to time are measured and compared to historical values. Alumina is fed to the cell only under conditions which, based upon a statistically reliable sampling of resistance values, give a substantial reliability that an electrode upset will occur if an alumina feed is not performed.

4 Claims, No Drawings

METHOD FOR IMPROVED ALUMINA CONTROL IN ALUMINUM ELECTROLYTIC CELLS

FIELD OF THE INVENTION

The present invention relates to a technique for controlling the amount of alumina fed to a reduction cell so as to avoid anode effects due to cell underfeeding and the build up of "muck" due to overfeeding.

BACKGROUND OF THE INVENTION

In the conventional operation of electrolytic reduction cells which reduce alumina, $Al_2O_3$ to aluminum, Al, the alumina is added to the cell according to a prescribed fixed time schedule.

The basic inherent disadvantage to this conventional method of controlling alumina additions to reduction cells, that is, breaking a specified area of a crusted layer of alumina into the molten cryolitic bath based on a fixed time interval cycle, is that there is no means of sensing the amount of alumina in the bath and taking corrective action.

Thus, if an excessive quantity of alumina is added over a length of time, there will be an accumulation of material, "muck," on the sides and bottom of the cathode that will eventually result in operational difficulties that decrease metal production. On the other hand, if too little alumina is consistently added to the cell, extra energy is required to operate the cell due to the increased anode overpotential, and the "anode effect" frequency which results from such underfeeding increases, lowering the metal production in all of the cells in the potline.

U.S. Pat. No. 3,583,896 to Piller issued June 8, 1971, describes a method for detecting "electrode upsets" in an aluminum reduction cell wherein the cell's so-called zero current intercept ($E_k$) is monitored. According to this method, a cell's voltage is measured at various times and current levels to determine the cell's operating characteristics. Projected zero-current intercept values, $E_k$, are then determined for those operating conditions. That is, for each condition, an extrapolation is made to determine what the cell's theoretical voltage would be if the current were zero. From this data a determination is made of the cell's "normal" $E_k$ value. If the $E_k$ value falls below a predetermined level corresponding to that set for the particular type of cell, it is taken as an indication that the cell is entering an electrode upset whereby operating procedures may be taken to control the cell so that the electrode upset can be reduced or eliminated.

Although the technique described by Piller provides a method for determining when an electrode upset may occur, thereby permitting corrective action which may comprise feeding of the cell or causing an intentional "anode effect," the method merely provides a means for detecting the critical conditions once they occur and not for preventing them in advance.

Thus, it would be highly desirable in the art if a system of "demand feed" were available whereby through some monitoring of the cell, information regarding the need, or lack of same, for feeding the cell could be provided. Put another way, the art has long sought a method whereby, through cell monitoring techniques, the cell would be fed automatically when it needed to be fed, but would not be fed if conditions where not suitable.

SUMMARY OF THE INVENTION

The present invention describes a method for controlling alumina additions to reduction cells referred to as "demand feed." Demand feed reduces the possibility of operating the cell at either too low or too high levels of alumina in the bath, and eliminates all anode effects except those desired, thus resulting in increased metal production.

The demand-feed cell operation of the present invention proceeds in the following manner:

1. The rate of change in the bath resistance of the cell with respect to time (slope) is determined. As the alumina content in the bath decreases due to metal production, bath resistance increases due to increased anode overpotential.

2. A statistical correlation co-efficient ($R^2$) of the last "N" number of readings of the cell's bath resistance is made.

3. If the following conditions exist:

(a) the slope is within a predetermined range of "g" volts/minute at the normalized line amperage, and if, (b) the correlation coefficient, $R^2$, exceeds a predetermined limit "h," and if, (c) the last break and feed operation has not been performed in the last "y" hours, then 4. A regular break/feed operation is performed. The minimum alumina concentration in the bath of the cell, prior to the break/feed operation by demand feed, depends upon the value selected for the slope requirement "g." The higher the value chosen for "g," then the lower will be the alumina content in the bath at the break/feed operation. High "g" values will neither minimize the cell's bath resistance nor maximize the ampere efficiency. If "g" values are chosen too low, it becomes more difficult to accurately predict a positive increase in the resistance slope due to low alumina compared to other effects, such as change in the line amperage.

DETAILED DESCRIPTION OF THE INVENTION

With demand feed, the feed intervals between the individual break/feed operations depend upon the alumina content in the bath. If extra alumina is added at a break, or due to other processes such as changing anodes, the time between break/feed operations automatically increases. No break/feed operation will occur until the alumina content in the bath has decreased to a low enough alumina level to cause an increase in the bath resistance, measured as a positive slope "g" by the monitoring computer.

Thus, the cell is prevented from obtaining an excessive accumulation of alumina in the bath due to such events as changing anodes, extra breaks, changes in alumina properties (density), etc., as the interval between break/feed will automatically extend until the higher alumina level decreases to normal levels.

In the event of underfeeding, i.e. too little alumina in the path, the time intervals between break/feed operations will decrease to maintain a minimum alumina level.

The rate of change in bath resistance for a given cell configuration is obtained by measuring such resistance using conventional amperometric techniques on a typical cell of the specified configuration when the cell is intentionally driven to an overfed or underfed condition under controlled conditions. Thus, for a given cell type the bath resistance is monitored over time as controlled over- and underfeeding of the cell is performed. These measurements will define a line when resistance vs. time is graphed. The slope of this line will, of course, define the rate of change in the resistance of the cell with respect to time.

The bath resistance described above is normally monitored by monitoring the line resistance of the test cell and ultimately the line resistance of any controlled cell. Such measurements are, of course, subject to certain inherent inaccuracies due to a number of factors which include: (1) the accuracy of the measuring equipment and external influences on the cell such as anode movement, current changes which are not detectable since most monitoring is based on an assumed constant EMF which may not (and generally is not) actual; (2) manual manipulation of the cell in some manner which is not reportable by the control system; (3) distortion of the metal pad due to current changes, etc. Thus, to compensate for such events, a statistical technique must be applied to test the accuracy of the resistance data being obtained. For simplicity, the resistance of a cell is expressed as a normalized voltage:

$$VN = \frac{(VR - BEMF)}{(Ar)} Ab + BEMF$$

where:

Vn=cells voltage normalized to the base amps.

Vr=voltage read.

Ar=base amps. This is normally close to the average line amps.

BEMF=average back electronic force back EMF of the cell.

An inspection of this equation reveals that the voltage across a cell is composed of two general types. The first (VR) is ohmic in nature while the second is back EMF and therefore nonohmic. There would not be any problems with determining cell resistance (normalized voltage) if the line current were constant. However, this is never the case in an operating environment. Therefore, the major error in determining resistance arises in the following manner:

1. The back EMF is not constant, but varies according to the chemical composition of the electrolytes. An error as small as 100 mv between the average back EMF and the actual back EMF of a cell with a line current change of 10 kilo amps will result in an error in the cell resistance calculation of an order of magnitude larger than the change in resistance used to infer alumina concentration for control purposes.

2. With a change in line current, there is an associated change in magnetic field. If the change in magnetic field lasts long enough, the paramagnetic molten aluminum in the bottom of the cathode will take a new physical shape. This results in an effective change in anode to cathode distance with its corresponding change in cell resistance. This type of error in resistance reading is on the same order of magnitude as the change in resistance used for control purposes.

3. Operator intervention to perform various tasks such as tapping, anode changing, etc. may cause errors of orders of magnitude larger than the resistance change used to infer alumina concentration.

4. Computer control actions also result in resistance error, but are relatively easy to deal with since the exact nature of these actions is known.

With the knowledge that the above mentioned errors exist, the herein disclosed control technique was designed. The system makes multiple readings of the cell resistance over time, discarding those readings where the line current is not sufficiently close to the base line current to find a single point in the resistance vs. alumina curve. A number of these points are then used to calculate the present rate of change in cell resistance and the correlation coefficient between the points. This technique minimizes the essentially random errors associated with changes in line current since the readings are selectively chosen and since the error will diminish with the square root of the number of readings. During the time that rate of change of resistance is small, the data points will have a random error which results in a low correlation coefficient. As the rate of change in slope increases, it becomes larger than the random errors, resulting in a higher correlation coefficient which is employed for control purposes. Errors caused by operator intervention are detected because the control system reads the status of the automatic/manual switch located on the cell control panel. This switch must be placed in the manual setting before actions can be taken. In the case of operator intervention, the control system requires that a higher than normal correlation coefficient be obtained before making a break/feed operation. The method is effective because most operating events of significance result in step changes in resistance which disturbs the correlation coefficient.

If the control system has found it necessary to adjust the anode bridge, an error in the resistance calculation results. This is negated by the assumption that there would not have been a change in resistance if the control system had not caused it. Therefore, subsequent resistance readings are corrected for this event.

No anode effects will occur in cells operated on demand feed as the cell's bath resistance indicates a break/feed operation from 15 to 45 minutes prior to the onset of the anode effect.

Thus, demand feed provides a method to sense, or estimate, alumina levels in the bath and to take corrective action by automatically making adjustments in the time interval between each break/feed operation to adjust for too low or too high alumina levels and prevent anode effects.

1. If the cells are underfed alumina at breaks, the time between breaks is decreased. The time between break cycle varies as a function of the amount of alumina added at each break.

2. If cells are overfed, the time between breaks is decreased. Thus, the program is self-compensating with respect to the amount of alumina added at break, or added due to other cell operations or changes in alumina density.

With this outline of the procedures used for "demand feed" of a reduction cell in mind, the methods used to select the variables noted hereinabove and to adjust for the aforementioned "events" which may affect resistance readings will now be described.

According to the method of the present invention for a given cell structure or configuration, the following steps are performed:

(a) The rate of change in bath resistance of the cell with respect to time is determined to define a line slope.

(b) A statistical correlation coefficient, $R^2$, of the last N number of readings of the cell's bath resistance is made; and, if all of the following conditions exist, a break/feed is made:

(i) The slope is within a predetermined range of "g" volts/minute at a normalized line amperage;
(ii) The correlation coefficient, $R^2$, exceeds a predetermined limit H, and
(iii) The last break/feed operation has not been performed in the last y hours.

In order to achieve a complete understanding of the process of the present invention, it is, of course, necessary to understand the methods used to determine and/or specify each of the variables g, N, $R^2$ and H.

Thus, selection of values for "g" and "h" in the present process is made in the following manner:

A large number of anode effects are permitted to occur in a cell of a configuration typical of that in those to be controlled while tracking the pot resistance versus time preferably with a computer control system;

A point is then empirically chosen on the resistance vs time graph at which there exists a high degree of confidence (i.e. greater than 80%) that the increasing resistance is due to the decreasing alumina concentration and not due to other causes.

The minimum limits for the slope ("g") and correlation coefficient ("h") are chosen to be those that are present at the above defined and preselected point.

The resistance vs time graph is also studied to determine the effect of events such as an anode bridge adjustment, tapping, etc. These events generate slopes much higher than those associated with an increase in resistance due to decreasing alumina. In this manor, a maximum limit for the slope ("g") is also chosen to exclude the above mentioned events from consideration.

The statistical technique applied to verify the accuracy of the measured resistance values in this instance is that commonly referred to as the least square line. This technique is well known and the details of its application can be found in any standard text on statistics, for example Numerical Mathematical Analysis, James B. Scarborough, Johns Hopkins Press, Baltimore, Md., Sixth Ed. 1966, PG 533ff.

In abbreviated form the least square line approximating the set of points $(X_1,Y_1)$, $(X_2,Y_2)$–$(X_n,Y_n)$ (for example in the resistance vs. time graph of the present invention) for the equation:

$$Y=Ao+A_1X$$

where the constants Ao and A are determined by solving simultaneously the equations:

$$\Sigma Y=AoN+A_1\Sigma X$$

$$\Sigma XY=Ao\Sigma X+A_1\Sigma X^2$$

The constants Ao and A can be found by:

$$Ao=\frac{(\Sigma Y)(\Sigma X^2)-(\Sigma X)(\Sigma XY)}{N\Sigma X^2-(\Sigma X)^2}$$

$$A_1=\frac{N\Sigma XY-(\Sigma X)(\Sigma Y)}{N\Sigma X^2-(\Sigma X)^2}$$

$$R=\frac{N\Sigma XY-(\Sigma X)(\Sigma Y)}{[N\Sigma X^2-(\Sigma X)^2][N\Sigma Y^2-(\Sigma Y)^2]}$$

WHERE:

Ao is the value of Y at X=0

A is the slope of the line.

$R^2$ is the correlation coefficient and is zero if there is no correlation between the resistances, and is 1 if there is perfect correlation.

The value "y" which represents the number of hours since the last break/feed operation will again depend upon the particular cell configuration. The value "y" will thus normally be selected as ½ the normal break/feed time in an uncontrolled cell of the specified configuration. Such a value for "y" will constitute at least a good starting point and experience with the cell control technique described herein will determine whether this value should remain at this level or diminished (i.e. shortened) or enlarged (i.e. lengthened). Normally, N will be between about ½ and about 2 hours.

The following Example demonstrates the beneficial results obtained when cells are operated according to the method described herein as compared to operation using conventional timed cell feed.

EXAMPLE I

The impact of alumina control by demand feed compared to a regular 2 hour breakcycle is demonstrated in the following Table I which demonstrates the results of operating identical cells under each of the techniques:

TABLE I

| | Regular 2-Hr. Break | Demand Feed Program |
|---|---|---|
| Alumina per pot day, kg | 2008.1 | 2008.1 |
| No. of alumina dumps per break | 6 | 8 |
| Alumina per dump, kg | 18 | 18 |
| Break cycle, hr | 2.0 | (1.5–2.5) |
| No. alumina dumps per pot day | 72 | 96 |
| No. anode effects per pot day | 3.0 | 0.5* |
| Alumina from: | | |
| break, kg | 1296 (64.5%) | 1728 (86.1%) |
| anode effect, kg | 324 (16.1%) | 72 (3.6%) |
| break after A.E., kg | 162 | 0 |
| carbon set, kg | 108 | 108 |
| break after tap, kg | 108 | 108 |
| TOTAL | 1998 | 2016 |

*As programmed

It is evident from the table that cells operated on the regular 2-hour break cycle are being underfed alumina. Only 64.5% of the alumina required at 150 KA is generated from the break cycle. The difference in alumina was being supplied from the three additional anode effects per day. About 24% is generated from 3 anode effects per day and the associated break 30 minutes after the anode effect. The remaining 10.8% alumina required per pot day is derived from that added after tapping and setting carbon.

If more alumina dumps were added at break to the regular 2-hour cycle, the muck levels would increase significantly in the cathodes due to excessive alumina in the cell during periods of extra breaks, carbon settings, tapping, etc. In addition, the cell would then be broken at 2-hour intervals, regardless of the alumina content in the liquid bath.

It is also evident that the break operation during the demand-feed program supplies most of the alumina required (86.1%) for a 24-hour period of cell operation. The cells have no anode effects other than those requested or due to empty ore bins.

Results of plant studies show that metal production (ampere efficiencies) for reduction cells operating on computer-controlled, demand-feed were consistently higher than those for cells operating on a conventional 2-hour break cycle, for example, 89% compared to 87% ampere efficiency. The demand feed program was successful in eliminating all anode effects except those requested or caused by empty ore bins.

We claim:

1. A method for controlling the amount of alumina fed to a reduction cell so as to avoid overfeeding or underfeeding of the cell comprising the steps of:

(a) experimentally intentionally over-and-under-feeding a control cell of the type of the cell to be controlled under controlled conditions to determine statistically significant values of:

(i) a rate of change in bath control cell resistance with respect to time and alumina concentration to define a line slope, "g";

(ii) a statistical correlation coefficient of the last N number of readings of the resistance of the control cell, h; and (iii) a number of hours since the last break/feed option y;

(b) determining the rate of change in bath resistance of the cell to be controlled with respect to time and alumina concentration to define a line slope, g;

(c) defining a statistical coefficient, $R^2$, of the last N number of readings of the bath resistance of the cell to be controlled; and (d) performing a break/feed if all of the following conditions are met:

(I) the slope g is within the experimentally determined range of "g" volts/minute at a normalized line amperage;

(II) $R^2$ exceeds the experimentally determined limit h; and (III) the last break/feed operation has not been performed in the last y hours.

2. The method of claim 1 wherein "g" is selected such that there is a degree of confidence of at least 80% that an electrode upset will occur if a feed/break is not performed.

3. The method of claim 2 wherein the value $R^2$ is determined by the least square line method and the value h is selected as at the correlation coefficient which exists at the point "g."

4. The method of claim 1 wherein the value for y is between about ½ hour and about 2 hours.

* * * * *